United States Patent [19]

Kasama

[11] 4,389,756

[45] Jun. 28, 1983

[54] CLASP FOR SWIMMING ARTICLE

[75] Inventor: Masatoshi Kasama, Chiba, Japan

[73] Assignee: Kinugawa Pacific Kabushiki Kaisha, Japan

[21] Appl. No.: 226,595

[22] Filed: Jan. 21, 1981

[30] Foreign Application Priority Data

Jul. 23, 1980 [JP] Japan ..... 55-103216[U]

[51] Int. Cl.[3] ..... A44B 11/10

[52] U.S. Cl. ..... 24/171; 24/196

[58] Field of Search ..... 24/171, 176, 181, 186, 24/187, 195, 196, 198, 200

[56] References Cited

U.S. PATENT DOCUMENTS

| | | | |
|---|---|---|---|
| 1,374,691 | 4/1921 | Troop | 24/196 |
| 3,155,987 | 11/1964 | McGill | 24/186 X |
| 3,327,361 | 6/1967 | Mathison | 24/198 |
| 3,831,226 | 8/1974 | Nelson et al. | 24/196 |

*Primary Examiner*—Robert P. Swiatek

*Attorney, Agent, or Firm*—McGlew and Tuttle

[57] ABSTRACT

A clasp used with a swimming article for tightening a strap wherein the clasp comprises two main portions: a frame member formed of a resilient material having longitudinal recesses along two opposite sides of the frame member and having two cutaway portions formed on the same sides of the plane of the frame member and at diagonally opposite corners thereof, and a movable bar whose opposite ends are adapted to slide in the recesses in the opposite sides of the frame member and which is adapted to be inserted into the frame by passing the ends of the bar through the cutaway portions, and into the recesses. The movable bar is snap fitted while being placed on the diagonal of the rectangle with its ends engaging with the cutaway portions, and is capable of sliding along the longitudinal recesses. A clasp in accordance with this invention is particularly useful in a diving mask or flippers.

5 Claims, 10 Drawing Figures

CLASP FOR SWIMMING ARTICLE

BACKGROUND OF THE INVENTION

This invention relates to a light-weight and rustproof clasp which can be inexpensively manufactured and is particularly well adapted for use as a clasp for a swimming article, by which is meant any article liable to dampness or moisture induced corrosion by being, for example, immersed in seawater. The clasp is made of material such as a synthetic resin and is particularly suitable for fitting to a diving mask or flippers.

A conventional clasp used in a swimming article such as a diving mask or flippers is shown in FIG. 1 and FIG. 2. It is made from some rustproof metal such as stainless steel and comprises a frame member 1 of approximately rectangular shape, and with inward facing claws at one side adapted to be attached to a swimming article, in combination with a movable bar 2. This conventional clasp has, however, defects, for example, since the ends of the movable bar 2 are fitted to the frame member 1 by bending them around the frame member (see FIG. 2), such that sharp edges left as burrs in the initial manufacturing stage are quite liable to remain in such a way as to snag against a strap threaded through the clasp. This may hamper tightening of the strap or lead to damage and eventually breakage of the strap. Additionally such a conventional clasp is very expensive in view of the cost of materials such as stainless steel.

Accordingly, though it has been proposed that a clasp of the same construction as the prior art illustrated could be made of a material such as a synthetic resin to avoid the above defect, there is a difficulty in manufacture of such an article, in the connection of the movable bar to the frame member.

SUMMARY OF THE INVENTION

Therefore, it is the object of the present invention to provide a clasp made of a synthetic resin and having the same function as a conventional stainless steel clasp, in which the clasp can be inexpensively manufactured, and is suitable for use on a diving mask or flippers.

Another object of the present invention is to provide flippers with a light-weight clasp which will not sink in water.

In this case the clasp according to the present invention provides more than the mere convenience of lighter flippers. Specifically, when a conventional clasp is provided at the heel end of a flipper, if released in the water the heavy clasp weighs down the flipper, which sinks rapidly. With the clasp according to the present invention, however, the flipper tends to remain horizontal, and therefore will sink only very slowly, if at all.

BRIEF DESCRIPTION OF THE DRAWINGS

The features and advantages of a clasp for a swimming article according to the present invention over a prior-art clasp will be more clearly appreciated from the following description taken in conjunction with the accompanying drawings in which like reference numerals designate corresponding elements and in which.

DESCRIPTION OF THE PREFERRED EMBODIMENT

Reference is now made to FIGS. 3 to 10, wherein is shown a preferred embodiment of the present invention.

Figure 1:
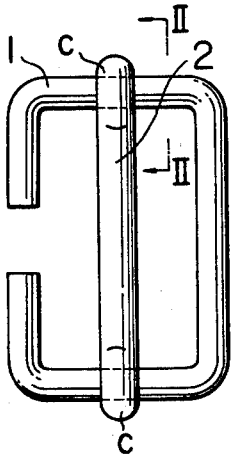
FIG. 1 (PRIOR ART)
FIG. 1 is a plan view showing a conventional clasp arrangement.
Figure 3:
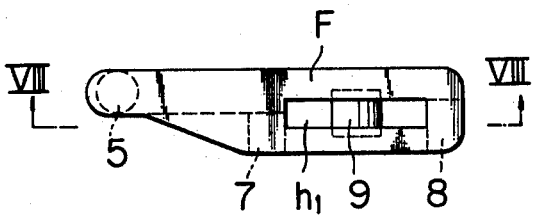
FIG. 3 is a side view of a preferred embodiment of the present invention.

FIG. 3 is a side view of a preferred embodiment of the present invention. In this figure, longitudinal slots $h_1$ and $h_2$ (only $h_1$ being shown) formed along two opposite sides of a frame member F extend for substantially the entire length of the respective sides. A movable bar 9 is mounted within the frame member F, with the ends of the movable bar 9 sliding in the recesses $h_1$ and $h_2$.

Figure 4:
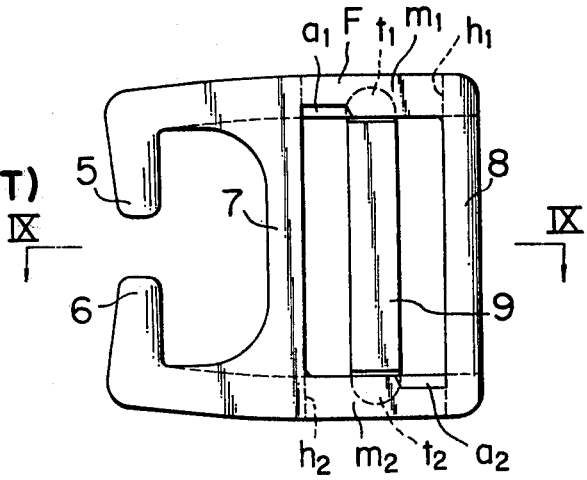
FIG. 4 is a plan view of the embodiment of FIG. 3.
Figure 2:
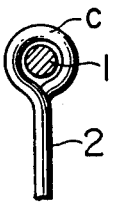
FIG. 2 (PRIOR ART)
FIG. 2 is an enlarged sectional view along line II—II in FIG. 1.

FIG. 4 shows a plan view of the preferred embodiment, and illustrates clearly the structure of the frame member F, with a dividing portion 7 and an end portion 8, and claws 5 and 6, a movable bar 9 and cutaway portions $a_1$ and $a_2$. The frame member F is formed integrally with the pair of inward facing fixing claws 5 and 6 on the outside as shown in FIG. 4 and is made of a flexible synthetic resin.

The exact shape and orientation of the claws 5 and 6 as means for affixing the clasp to the article is not a limiting feature of the present invention. In particular, references to the rectangular frame refer to the rectangle defined by members 7, 8, $m_1$ and $m_2$, and do not include the form of the claws 5 and 6.

According to the present invention, longitudinal recesses $h_1$ and $h_2$ are formed in the inside of the central portions $m_1$ and $m_2$ of the frame member. In this embodiment these recesses are slots formed through the thickness of portions $m_1$ and $m_2$, but this need not necessarily be the case. Equally, grooves might be provided on the inside only of portions $m_1$ and $m_2$. Also the frame member has the two cutaway portions $a_1$ and $a_2$ formed on the same side of the plane of the frame member at diagonally opposite corners thereof to enable the bar to be easily snap fitted in place.

Figure 5:
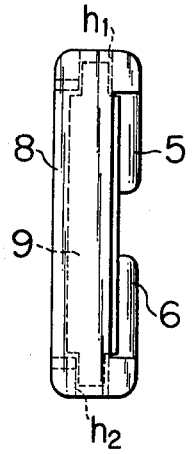
FIG. 5 is a side view, as seen from the right, in FIG. 4.

FIG. 5 shows the right side view of FIG. 4 in which the bar 9 is engaged with the inside portions of the central portions $m_1$ and $m_2$ of the frame member. Claws 5 and 6 are also indicated.

Figure 6:
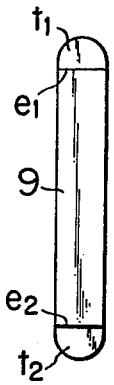
FIG. 6 is a plan view of a movable bar.
Figure 7:
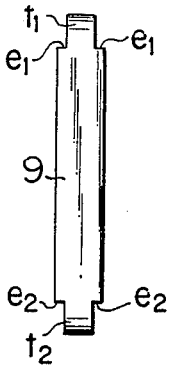
FIG. 7 is a side view of the movable bar of FIG. 6.

FIGS. 6 and 7 respectively show a front view and a side view of the movable bar.

In addition to the above FIGS. 4 and 5, FIGS. 6, 7 and 8 mainly show the shape of the movable bar and its situation in the frame member. Namely, the movable bar 9 is made of a synthetic resin which is the same resilient material as that of said frame member F, having semicircular portions $t_1$ and $t_2$ of reduced thickness at each end and step portions $e_1$ and $e_2$, and this bar is snap fitted by being pressed at diagonally opposite corners through the two cutaway portions $a_1$ and $a_2$.

Figure 8:
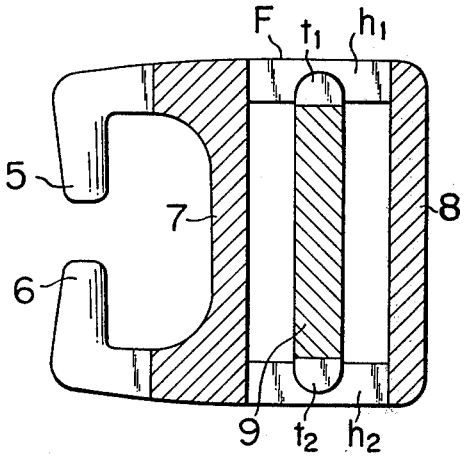
FIG. 8 is a sectional view along line VIII—VIII in FIG. 3.

Furthermore, as shown in FIG. 8, the movable bar 9 is adapted to slide along said recesses in the opposite sides of the frame member F. The frame member F and bar 9 are dimensioned such that the effective length of the bar marginally exceeds the diagonal clearance of the frame member, whereby the resilience of the frame member allows the bar to be pressed into position, but the relaxed shape of the frame member prevents the bar from being easily removed.

For optimum results the ratio of the lengths of the inner side edges of the frame member F is in the range 2:3 to 2:5, with the recess in the shorter sides.

Figure 9:
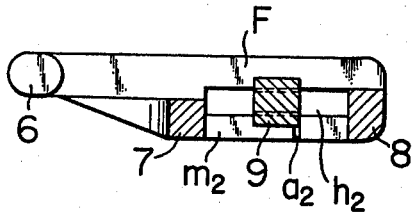
FIG. 9 is a sectional view along line IX—IX in FIG. 4.

FIG. 9 shows a sectional view along a line IX—IX in FIG. 4. It will be seen here that when the movable bar 9 is slidably engaged within the slots ($h_2$) in the frame member F, the thicker portion of the bar prevents the frame member and the bar from being separated. As is shown in FIGS. 3, 4 and 8, the longitudinal recesses extend for substantially the entire lengths of the respective sides.

Figure 10:
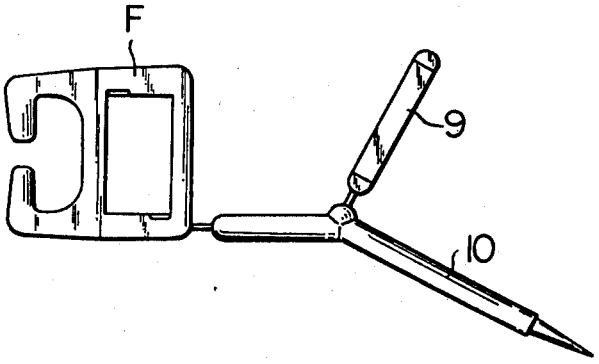
FIG. 10 is a plan view of the integrally molded frame member and bar.

FIG. 10 shows a front view of the integrally molded frame member and bar. The frame member F and the movable bar 9 are integrally molded together with a waste portion 10 in a single mold, from a synthetic resin of suitable properties. After solidification, the integrally molded frame member and bar as shown in FIG. 10 are removed and the frame member and bar are separated and are assembled together by snap fitting in such manner that the resilience of the frame member and the bar prevents the frame member and the bar from being easily separated. The bar is snap fitted while being placed on the diagonal of the rectangle with its ends engaging with cutaway portions $a_1$ and $a_2$.

As described above, according to the present invention, a user can tighten a strap (not shown in the drawing) threaded through the frame member F when attached to a swimming article such as a diving mask or flippers according to the movable bar which is capable of sliding along the longitudinal recesses $h_1$ and $h_2$.

It is further to be understood by those skilled in the art that the foregoing description is of a preferred embodiment of the present invention and that various changes and modifications may be made without departing from the spirit and scope thereof.

What is claimed is:

1. A clasp for a swimming article which comprises a frame member of substantially rectangular shape formed of a resilient material and having longitudinal slot recesses formed along two opposite sides of the frame member and further having two cutaway portions formed on the same side of the plane of the frame member and at diagonally opposite corners thereof and correspondingly communicating with the recesses, including means on the frame member for affixing it to a portion of said article and a movable bar formed of a resilient material and whose opposite ends are adapted to slide in said recesses in the opposite sides of the frame member and which is adapted to be inserted into sliding position in the frame by passing the ends of the bar through the cutaway portions and into the recesses, wherein the frame member and bar are dimensioned such that the effective length of the bar marginally exceeds the diagonal clearance of the frame member, whereby the resilience of the frame member and the bar allows the bar to be pressed and inserted into position, but the relaxed shape of the frame member prevents the bar from being easily removed.

2. Clasp according to claim 1, wherein the bar has a portion of reduced thickness at each end adapted to engage with a corresponding one of the recesses.

3. Clasp according to claim 1, wherein the opposite sides of the frame member incorporating the longitudinal recesses are the shorter sides of the corresponding rectangle, and the longitudinal recesses extend for substantially the entire lengths of the respective sides.

4. Clasp according to claim 1, wherein the resilient material of the frame and bar is a flexible synthetic resin.

5. Clasp according to claim 1, wherein the frame member and bar are snap fitted in such manner that the resilience of the frame member and the bar prevents the frame member and the bar from being easily separated.

* * * * *